US008893694B1

(12) United States Patent
DeBole

(10) Patent No.: US 8,893,694 B1
(45) Date of Patent: Nov. 25, 2014

(54) DRAW EXTENDING ARCHERY SYSTEM

(76) Inventor: Robert DeBole, Winston-Salem, NC (US)

( * ) Notice: Subject to any disclaimer, the term of this patent is extended or adjusted under 35 U.S.C. 154(b) by 123 days.

(21) Appl. No.: 13/542,594

(22) Filed: Jul. 5, 2012

Related U.S. Application Data

(60) Provisional application No. 61/504,922, filed on Jul. 6, 2011.

(51) Int. Cl.
*F41B 5/10* (2006.01)

(52) U.S. Cl.
USPC ..... 124/25.6

(58) Field of Classification Search
USPC ..... 124/23.1, 25.6, 86, 900
See application file for complete search history.

(56) References Cited

U.S. PATENT DOCUMENTS

| | | | | |
|---|---|---|---|---|
| 3,726,459 A | | 4/1973 | Defontenay | |
| 3,782,208 A | | 1/1974 | Hacker | |
| 3,977,263 A | | 8/1976 | Nara | |
| 4,425,988 A | | 1/1984 | Stock et al. | |
| 4,478,202 A | * | 10/1984 | Anderson | 124/23.1 |
| 4,757,799 A | * | 7/1988 | Bozek | 124/25.6 |
| 4,903,677 A | * | 2/1990 | Colley et al. | 124/23.1 |
| 5,454,277 A | | 10/1995 | Imase | |
| 5,950,609 A | | 9/1999 | Thielen et al. | |
| 2013/0061839 A1 | | 3/2013 | Asherman | |

* cited by examiner

*Primary Examiner* — John Ricci
(74) *Attorney, Agent, or Firm* — Fenwick & West LLP

(57) ABSTRACT

A draw extending archery system enables a user to draw a draw string multiple times to store energy. Embodiments of the system include a transmission that operatively engages the draw string and a flexible limb. From an initial rest position, the user initiates a charging stroke on the draw string. During a first charging stroke, the transmission engages to store energy during the draw. At the end of the charging stroke, the transmission engages to prevent release of stored energy. The transmission also disengages the draw string to enable a subsequent charging stroke from an intermediate rest position. From a final rest position, the user initiates a firing stroke on the draw string. At the end of the firing stroke, the transmission couples the draw string and the flexible limb to release stored energy through the draw string.

24 Claims, 9 Drawing Sheets
(9 of 9 Drawing Sheet(s) Filed in Color)

100a

100a

100a

100b

DRAW EXTENDING ARCHERY SYSTEM

CROSS REFERENCE TO RELATED APPLICATIONS

This application claims the benefit of U.S. Provisional Application No. 61/504,922, filed Jul. 6, 2011, which is incorporated by reference herein in its entirety.

BACKGROUND

1. Field of Art

The disclosure generally relates to the field of archery and more specifically to a system for storing energy through multiple draw strokes.

2. Background Information

Ever since the bow and arrow first appeared in the late Paleolithic period, man has sought to improve its performance. Relatively speaking, however, operation of the modern bow is similar to that of historic specimens found in Holmegaard, Denmark, dating back over 8,000 years. The historical bow itself evolved into various forms such as the recurve bow, composite bow and other designs as makers sought to improve efficiency, arrow speed, accuracy and other performance characteristics. Historical development of the bow reached its peak in both complexity and power in the form of the crossbow, which was phased out in favor of firearms.

In recent times, however, the bow has made a comeback as a tool for hunters and hobbyists seeking a traditional experience. The 1960's saw a revolution in bow technology with the advent of the compound system for bows and crossbows, or simply "compound bow". The compound bow increases accuracy and mechanical efficiency over historical designs. Following conception of the compound bow, a number of different designs involving a single draw of the draw string for every shot have been developed and commercialized. Though an improvement over historical designs, the single draw compound bow has its own limits.

Generally, as the energy stored in a bow is equal to the force of the draw multiplied by the distance of the draw, energy output is limited by user capability. For example, draw force is limited by the strength of the user and draw distance is limited by the reach of the user, both of which have upper limits. Some attempts have been made to design a bow that will shoot arrows faster than a standard compound bow, but nearly all involve a power assist.

SUMMARY

The above-mentioned and other problems are addressed by a draw extending system that enables a user to draw a bow's draw string multiple times to store energy in a flexible limb. Through successive charging strokes of the draw string, the draw extending system stores successive amounts of energy in the flexible limbs and thusly shifts energy output limitations from user capability to strength of materials and mechanics. Accordingly, the draw extending system enables a given user to achieve greater arrow speeds and/or use heavier projectiles than their physical capability previously allowed.

In one embodiment, the draw extending system effectively extends the length of the draw past the previous limit, which was a user's wingspan. Consider a bow with a manageable draw weight, such as 70 pounds, and a draw length of 30 inches (ignoring brace height for simplicity). Embodiments of the draw extending system include a transmission that, while keeping the actual draw length and draw weight the same for the user, enables multiple inputs (e.g., several 30 inch draws) on the draw string to create a longer effective draw length (e.g., 90 inches) for storing more energy. For example, one embodiment of the transmission may divide an effective draw length over three draws to increase storage of energy.

In another embodiment, the draw extending system enables a given user to use a bow with a heavier draw weight. Consider, again, the above example bow with a draw weight of 70 pounds and an effective draw length of 90 inches. Embodiments of the draw extending system include a transmission with a reduction mechanism that, while shortening effective draw length (e.g., down from 90 inches), increases leverage over the flexible limb when drawing the bow. Increasing leverage over the limb with the reduction mechanism decreases the effective draw weight felt by the user. Thus, for example, one embodiment of the transmission may reduce actual draw weight (e.g., down from 70 pounds per draw) to decrease required user effort and retain storage of energy through addition of draws.

In one embodiment, a transmission of a bow transfers energy received through a number of inputs into one or more flexible limbs. In one embodiment, the transmission transfers energy through a reduction mechanism. Embodiments of the reduction mechanism may transfer power directly or modify leverage of its input over its output to increase or decrease user effort required for compression of the one or more limbs. At the end of each charging stroke, the transmission engages to prevent release of energy from the limbs. Once an appropriate number of charging strokes are completed, the energy in the limbs may be released. In one embodiment, the transmission causes the flexible limbs to release substantially the sum of energy stored over the inputs into a string of the bow. Embodiments of a bow may use one or more transmissions for compressing flexible limbs coupled to a riser.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

The following description is presented to enable any person skilled in the art to make and use the invention. The Figures (FIGS.) and the following description describe certain embodiments by way of illustration only. One skilled in the art will readily recognize from the following description that alternative embodiments of the structures and methods illustrated herein may be employed without departing from the principles described herein. Reference will now be made to several embodiments, examples of which are illustrated in the accompanying figures.

Structural Overview

Figure 1A:
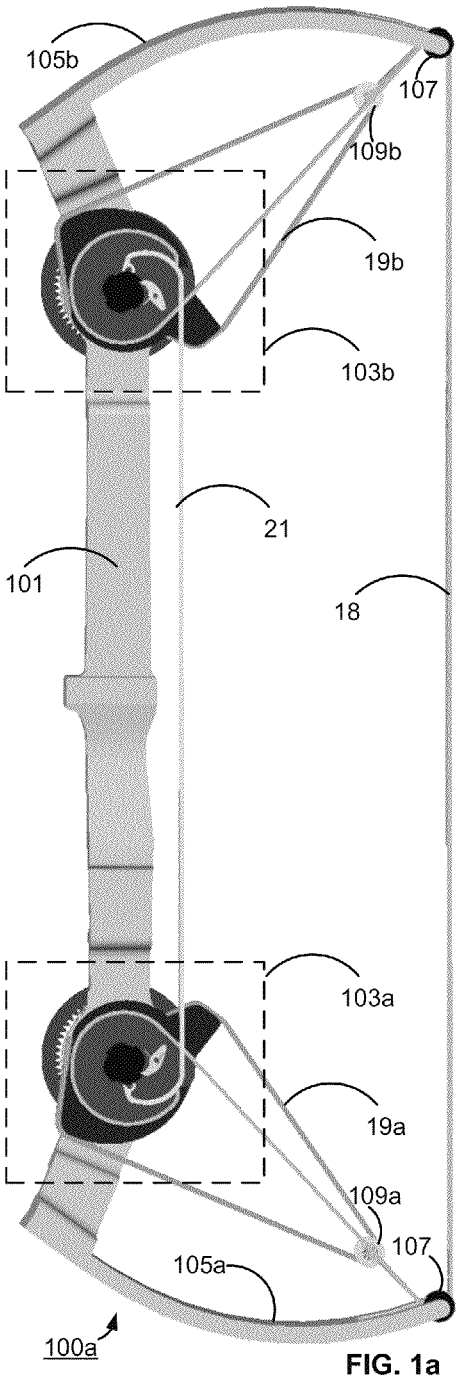
FIG. 1*a* is a schematic diagram illustrating a left-side view of a bow including a transmission according to one embodiment.

FIG. 1*a* is a schematic diagram illustrating a left-side view 100*a* of a bow including a transmission according to one embodiment. Structurally, the bow includes a riser 101 to which various components are attached. One skilled in the art will recognize that placement of the illustrated components and structure of the riser 101 may be altered to accommodate a right or left-handed user. Additionally, the bow may include structures such as a brace, rest and/or cable routing guides (not shown). Furthermore, one skilled in the art will readily recognize from the following description that alternative embodiments of the structures described herein, and principals and methods of their operation, are readily employable on a frame of a crossbow with a triggering mechanism.

One skilled in the art will further recognize that placement of the illustrated components and structure of the riser 101 may be altered to accommodate varying bow designs and preferences. For example, the transmission may be located anywhere on the riser 101 or on the limbs 105 themselves. Furthermore, the transmission and its components may be disposed within housing or the riser 101.

As shown in FIG. 1*a*, lower 105*a* and upper 105*b* limbs are coupled to the riser 101. A draw string guide 107 is coupled to each limb 105 for guiding the draw string 18 between lower 105*a* and upper 105*b* limbs. In one embodiment, the guides 107 freely rotate around shafts disposed in the limbs 105 as the user manipulates the draw string 18.

Lower 103*a* and upper 103*b* left-side transmission components are coupled to the riser 101 and facilitate transfer energy from the draw string 18 to the limbs 105 and vice versa in embodiments where the draw string 18 also functions as a shooting string. In alternate embodiments, the left side transmission components 103 may transfer energy to a shooting string (not shown) distinct from the draw string 18. The draw string 18 wraps around the guides 107 and is coupled to the lower 103*a* and upper 103*b* transmission components.

Lower 19*a* and upper 19*b* tension strings are respectively coupled to the lower 103*a* and upper 103*b* transmission components. The lower 19*a* and upper 19*b* tension strings respectively wrap around lower 109*a* and upper 109*b* tension guides. The tension guides 109 couple the tension strings 19*a*, 19*b* to a main tension string (not shown) that wraps around, and compresses the limbs 105.

In one embodiment, an elastic bias 21 is also coupled to the lower 103*a* and upper 103*b* transmission components. The elastic bias 21 tensions transmission components 103 after a charging stroke to reset the draw string 18 and draw in slack on the shooting string 18 due to compression of the limbs 105.

Figure 1B:
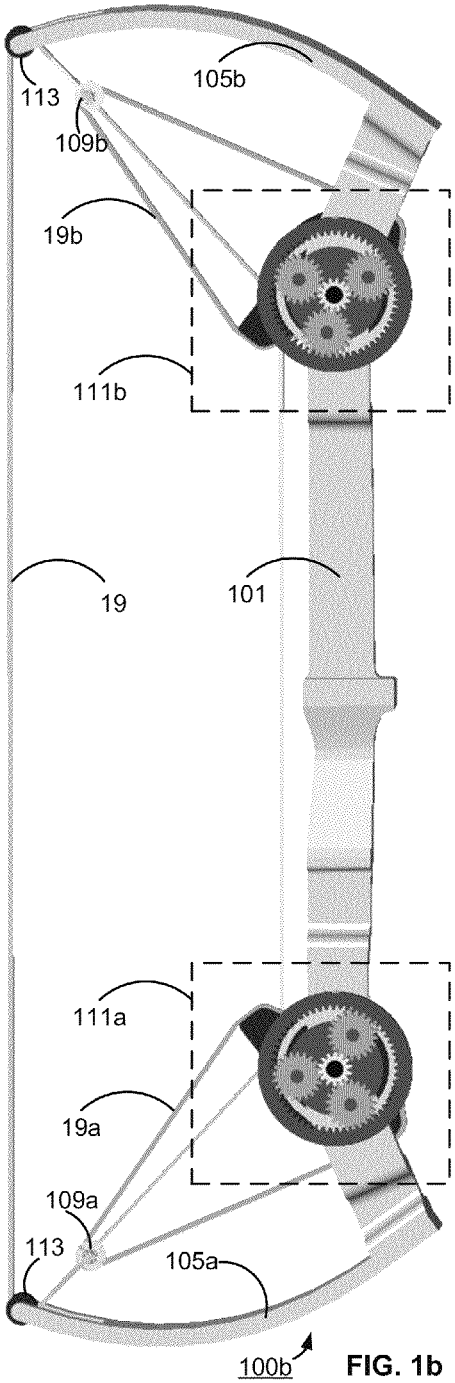
FIG. 1*b* is a schematic diagram illustrating a right-side view of a bow including a transmission according to one embodiment.

FIG. 1*b* is a schematic diagram illustrating a right side view of a bow including a transmission according to one embodiment. One skilled in the art will recognize that placement of the illustrated components and structure of the riser 101 may be altered to accommodate a right or left-handed user. For example, components illustrated in the right-side view 100*b* may be swapped with those illustrated in the left-side view 100*a* to swap the position of the draw string and tension string. Additionally, the bow may include structures such as a brace, rest and/or cable routing guides (not shown) that are also repositioned. Furthermore, one skilled in the art will readily recognize from the following description that alternative embodiments of the structures described herein, and principals and methods of their operation, are readily employable on a frame of a crossbow.

As shown in FIG. 1*b*, lower 105*a* and upper 105*b* limbs are coupled to the riser 101. A tension string limb guide 113 is coupled to each limb 105 for guiding a tension string 19 between lower 105*a* and upper 105*b* limbs. In one embodiment, the limb guides 113 freely rotate around shafts disposed in the limbs 105 as the user manipulates the draw string.

The main tension string 19 wraps around the limb guides 113 and is coupled to the lower 103*a* and upper 103*b* transmission components via the lower 109*a* and upper 109*b* tension guides and lower 19*a* and upper 19*b* tension strings.

Figure 1C:
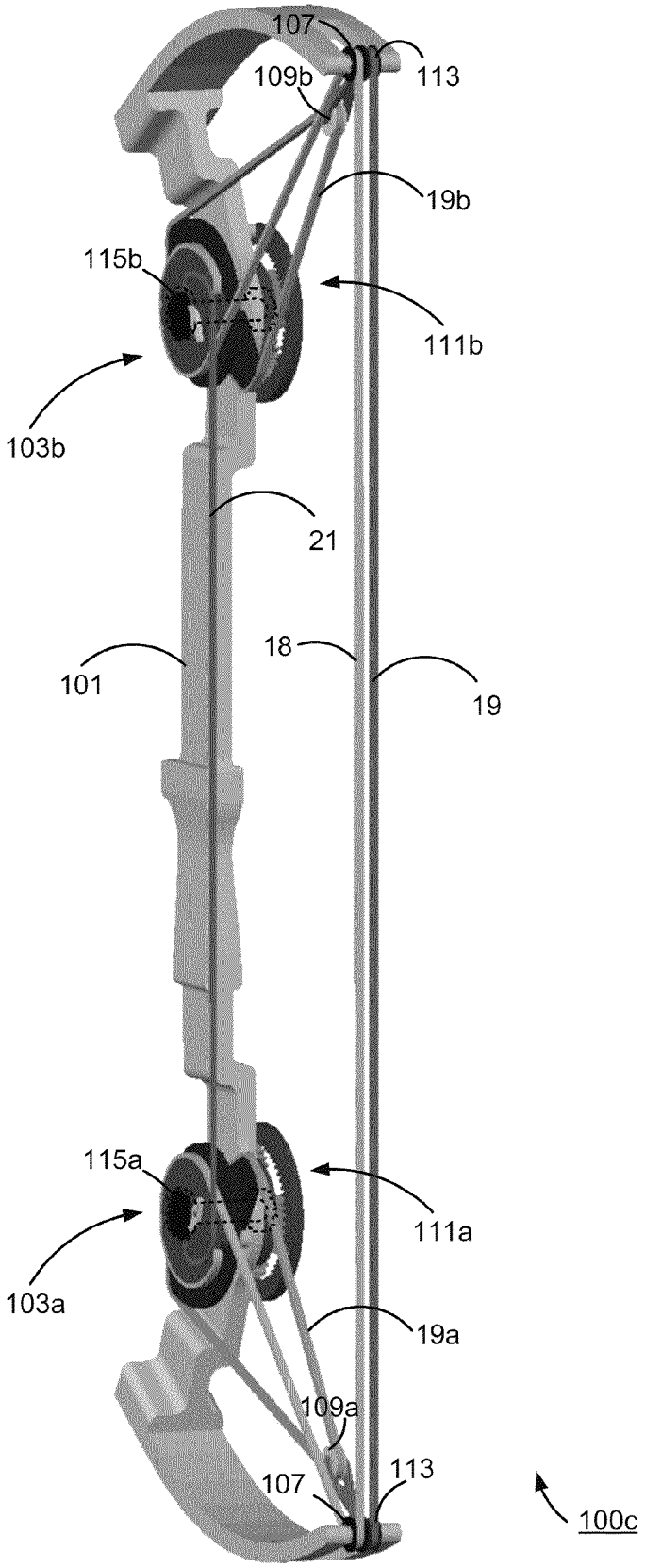
FIG. 1*c* is a schematic diagram illustrating a perspective view of a bow including a transmission according to one embodiment.

Also shown are lower 111*a* and upper 111*b* right-side transmission components coupled to the riser 101. The right-side transmission components 111 facilitate energy transfer from a draw string (not shown) to the limbs 105. In some embodiments, the right-side transmission components 111 include a reduction mechanism to reduce the effective draw weight of the bow for a user FIG. 1*c* is a schematic diagram illustrating a perspective view 100*c* of a bow including a transmission according to one embodiment. The lower right 111*a* and left 103*a* transmission components are positioned on the respective sides of the riser 101 as described above. FIG. 1*c* also illustrates example embodiments of the lower 115*a* and upper 115*b* drive shafts configured as selection components that operatively couple various components within each transmission in addition to functioning as a shaft (e.g., with bearings) for components to rotate around.

A lower input drive shaft 115*a* operatively couples the lower right 111*a* and left 103*a* transmission components. The lower input drive shaft 115*a* may further couple the lower transmission components 111*a*, 103*a* to the riser 101. Bearings, spacers and the like may facilitate freedom of rotation and secure coupling of the transmission components 111*a*, 103*a*, the lower input drive shaft 115*a* and the riser 101. Also shown are the upper right 111*b* and left 103*b* transmission components and an upper input drive shaft 115*b* which are similarly coupled to the riser 101.

FIG. 1*c* further illustrates the position of the draw string 18 with respect to the main tension string 19, draw string guides 107 and coupling to the left-side transmission components 103. The main tension string 19, its limb guides 113, and coupling to the lower 19*a* and upper 19*b* tension strings via tension guides 109*a*, 109*b*, respectively, are also illustrated for reference.

In one embodiment, the right 103 and left 111 side transmission component are oppositely configured (e.g., mirrored) from left to right on the riser 101 to swap the draw string 18 from the left side to the right side of the riser 101 and the main tension string 19 from the right side to the left side.

Alternatively, the positions of individual components, such as the main cams and tensioning cams which are discussed in greater detail with reference to FIGS. 2*a*, 3*a*, 3*b* and 4, may be swapped on the drive shaft to effect the swap in position of the draw string 18 and tension string 19. Other alternatives for changing draw and tension string positions on the limbs 105 include cable routing devices. Swap of the string 18, 19, component 103, 113, and cam positions may be beneficial, among other reasons, to accommodate left/right handed users, alter position of elastic bias 21 (e.g., for routing through the riser 101 or around a brace), ergonomics (e.g., bow or riser height), aesthetics and/or reduction in size or weight.

Additionally, in some embodiments, a single upper 103*b*, 111*b*, etc., or lower 103*a*, 111*a*, etc., set of transmission components may be used. Consider a single upper set of transmission components for example, one or more of the strings of the bow (e.g., 18, 19) may be coupled to the riser 101 after wrapping around the lower limb 105*a*, coupled to the limb 105*a* itself, or routed back to the upper set of transmission components. In another embodiment, the lower transmission may include fewer components than the upper transmission (or vice versa). For example, the lower transmission may include one or more cams and optionally, any necessary selection components, without reduction gearing and receive one or more of the strings of the bow. In some embodiments, the bow may include additional strings or mechanisms for synchronizing the upper and lower cams and/or other transmission components (e.g., when using one transmission with fewer and/or different components than another).

Example Method of Operation

Figure 2A:
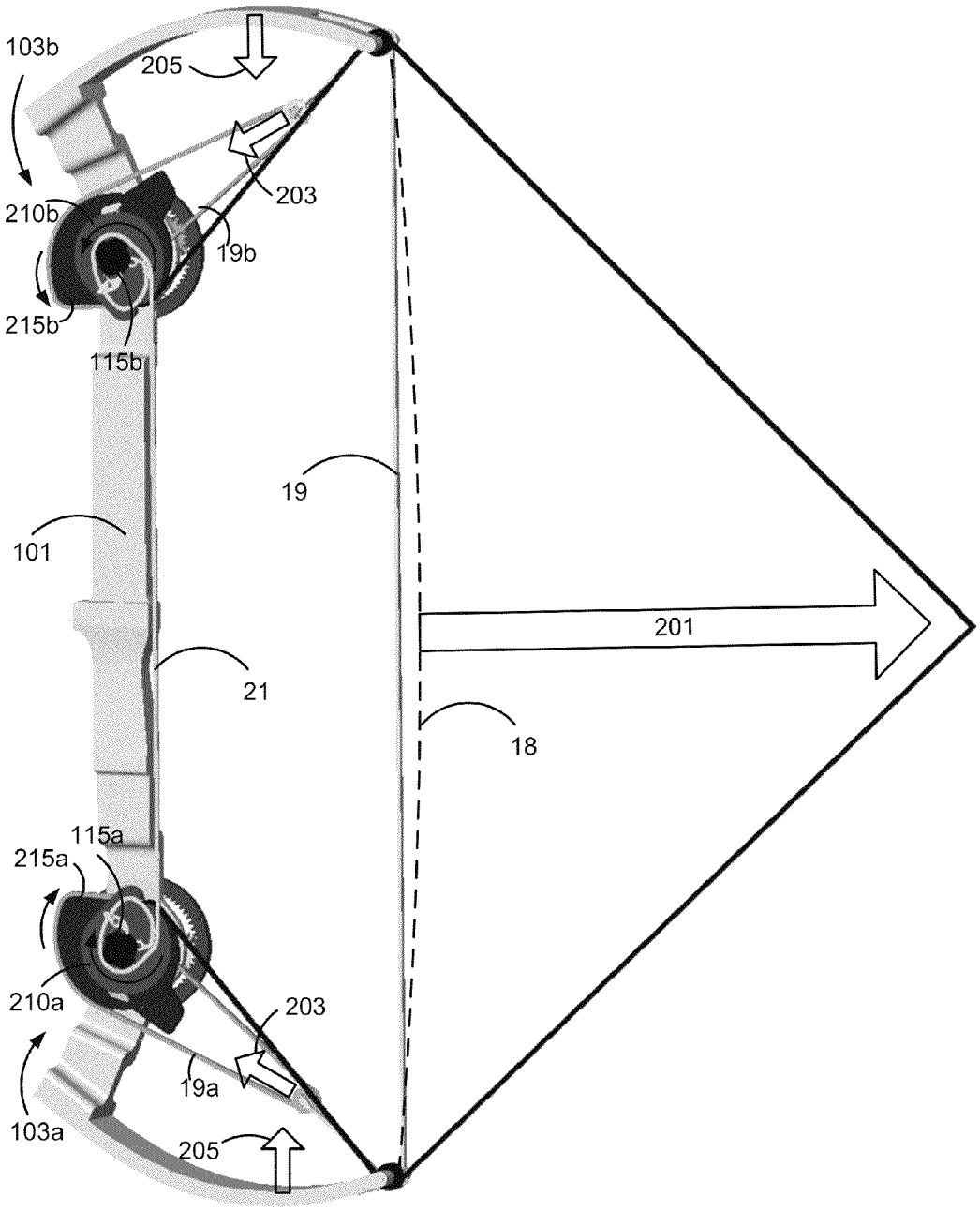
FIG. 2*a* is a schematic diagram illustrating a bow, including a transmission, being drawn from a left-side view, according to one embodiment.

FIG. 2*a* is a schematic diagram illustrating a bow, including a transmission, being drawn from a left-side view 100*a*, according to one embodiment. As shown, the lower 103*a* and upper 103*b* left-side transmission components include multiple components themselves. In some embodiments, configuration of the lower 103*a* transmission components is substantially mirrored across the axis of the draw 210 for configuring arrangement of the upper 103*b* transmission components.

The draw string 18 is coupled to lower 210*a* and upper 210*b* main cams and may be drawn 201 from a rest position to a fully drawn position. The main cams 210 are eccentric cams, pulleys or wheels which rotate around a central axis and house the draw string 18. As the main cams 210 rotate, they let out or reel in the draw string 18. FIG. 2*a* illustrates the directions of rotation of the respective main cams 210*a*, 210*b* during the draw 201.

The main cams 210 are operatively coupled to the respective drive shafts 115 (e.g., via a gear and pawl selection mechanism, known as a ratchet) to cause corresponding rotation in the same direction as the drive shaft during the draw 201. The drive ratchet allows the main cams 210 to rotate independently from the drive shafts 115 when the draw string 18 is returned to the rest position and/or the bow is fired. Accordingly, in some embodiments, an elastic bias 21 tensions the main cams 210 opposite of the draw string 18 to reel in slack as the draw string returns to the rest position.

The drive shafts 115*a*, 115*b* are respectively coupled to lower 215*a* and upper 215*b* tensioning cams. In one embodiment, the drive shafts 115 are coupled to the tensioning cams 215 via a reduction mechanism, which is illustrated in greater detail with reference to FIG. 2*b*. In either instance, drive shaft 115*a* rotates with the main cam 210*a* and drives the tensioning cam 215*a* in the same direction, as indicated, during the draw 201. As the tensioning cams 215 rotate during the draw 201, they reel in 203 the lower 19*a* and upper 19*b* tension strings to compress 205 the bow limbs 105.

In embodiments incorporating a reduction mechanism to decreases the effective draw weight, the main cams 210 and drive shafts 115*a* rotate faster and possibly further than the tensioning cams 215 throughout the draw 201.

In one embodiment, a selection component, such as a tensioning ratchet (not shown), operatively couples the tensioning cam (e.g., 215*a*) to the drive shaft 115*a* and causes the tensioning cam 215*a* to reel in the tension string 19*a* and compress the limbs 105 during the draw 201. The tensioning cam 215*a* remains coupled to the tensioning ratchet as the draw string 18 is returned to the rest position and prevents rotation in the opposite direction. Thus, the tensioning ratchet may prevent the release of stored energy in the limbs 105 after a draw 201 (e.g., a charging stroke) or otherwise maintains energy stored in the limbs subsequent to a charging stoke on the draw string 18.

In turn, to release energy stored in the compressed 205 limbs 105 (e.g., for firing a projectile subsequent a number of charging strokes), the tensioning cam 215*a* is decoupled (e.g., by a selection component, such as a selection gate) from the tensioning ratchet and outputs the energy stored in the compressed 205 limbs. The upper tensioning cam 215*b* may operate in a similar fashion.

In one embodiment, a firing stroke on the draw string 18 (e.g., after one or more charging strokes, or in some embodiments, a subsequent charging stroke that subsequently fires the bow) causes the transmission to decouple the tensioning cams 215 from the respective tensioning ratchets. The firing stroke may further compress the limbs 105 throughout the draw 201 as described above, but unlike previous charging strokes, causes the transmission to couple the draw string 18 at full draw to the limbs 105 (e.g., by a selection component for decoupling the tensioning cams from the tensioning ratchets which prevent decompression of the limbs). With the tensioning ratchet disengaged, the limbs 105 decompress and cause the transmission to transfer the stored energy into the draw string 18.

In one embodiment, the transmission includes a selection component (e.g., a cam output coupling) that couples the tensioning cams 215 to the respective main cams 210 when the bow is fully drawn 201 on the firing stroke. As the tensioning cams 215 are decoupled from the tensioning ratchets, the tensioning cams 215 output energy from the compressed 205 limbs 105 to torque the main cams 210. The main cams 210, in turn, tension the draw string 18 in preparation to fire. When the draw string 18 is released, the limbs 105 decompress and cause the cams 210, 215 to rotate (e.g., opposite the indicated direction). The main cams 210 and decompression of the limbs 105 force the draw string 18 opposite the draw 210 direction to launch the projectile. As the limbs decompress to their initial position prior to a draw stroke, they release substantially (e.g., less mechanical inefficiencies) the sum of energy stored over the charging strokes (and, optionally, in some embodiments the firing stroke).

Figure 2B:
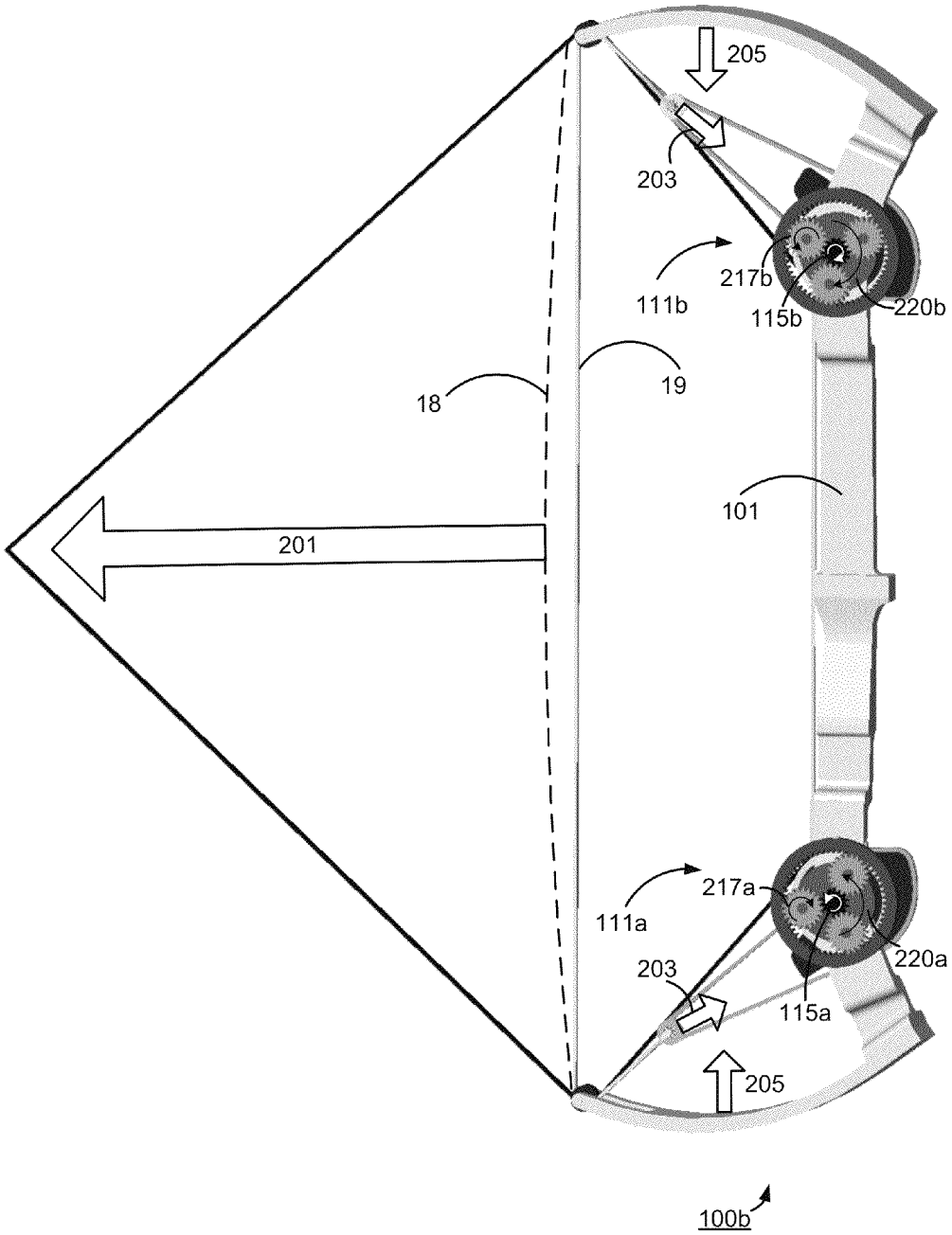
FIG. 2*b* is a schematic diagram illustrating a bow, including a transmission, being drawn from a right-side view, according to one embodiment.

FIG. 2*b* is a schematic diagram illustrating a bow, including a transmission, being drawn from a right-side view 100*b*, according to one embodiment. As shown, the lower 111*a* and upper 111*b* right-side transmission components include multiple components themselves. In some embodiments, configuration of the lower 111*a* transmission components is substantially mirrored across the axis of the draw 210 for configuring arrangement of the upper 111*b* transmission components.

The draw string 18 is coupled to lower 103*a* and upper 103*b* main cams 210 (not shown) and may be drawn 201 from a rest position to a fully drawn position. The main cams 210 are eccentric cams, pulleys or wheels which rotate around a central axis and house the draw string 18. As the main cams 210 rotate (e.g., when the draw string 18 is drawn 201 or the bow is fired), they let out or reel in the draw string 18. The main cams 210 are coupled to the respective drive shafts 115 (e.g., via a gear and pawl, known as a ratchet) and cause the drive shafts to rotate as indicated in FIG. 2*b* during the draw 201.

The drive shafts 115*a*, 115*b* are respectively coupled to lower 111*a* and upper 111*b* right-side transmission components to drive respective tensioning cams 215*a*, 215*b*. In one embodiment, the drive shafts 115 are coupled to the tensioning cams 215 via reduction mechanisms including reduction gearing 217*a*, 217*b* (e.g., planetary gears, sun gear and ring gear) and a tensioning ratchet 220 (e.g., functioning as a planetary carrier), which are illustrated in greater detail with reference to FIG. 6.

Alternatively, a drive shaft 115 may be coupled to the tensioning ratchet 220 directly, via another gearing mechanism, or ratchet (not shown). In either instance, each drive shaft 115 rotates as indicated to drive a tensioning ratchet 220 coupled to a corresponding tensioning cam (not shown) during the draw 201.

As the drive shafts 115 rotate and, in turn, cause the tensioning cams 215 to rotate during the draw 201, the lower 19*a* and upper 19*b* tension strings are reeled in 203 to compress 205 the limbs 105.

In embodiments incorporating a reduction mechanism to decreases the effective draw weight, the drive shaft (e.g., 115*a*) may rotate faster and possibly further than the tensioning ratchets 220 throughout the draw 201.

In one embodiment, a tensioning ratchet (e.g., 220*a*) is coupled to a tensioning cam 215*a* (not shown) and causes the tensioning cam to rotate during the draw 210. The tensioning cam 215*a* remains coupled (coupling not shown) to the tensioning ratchet 220*a* as the draw string 18 is returned to the rest position to prevent rotation in the opposite direction. Thus, the tensioning ratchet prevents the release of stored energy in the limbs 105 after the draw 201 (e.g., a charging stroke) or otherwise maintains energy in the limbs subsequent to a charging stoke on the draw string 18.

In turn, to release energy stored in the compressed 205 limbs 105 (e.g., for firing a projectile subsequent a number of charging strokes), the tensioning cam 215*a* is decoupled from the tensioning ratchet 220*a* and the tensioning cam outputs the energy stored in the compressed 205 limbs. The upper tensioning ratchet 220*b* may operate in a similar fashion.

In one embodiment, a firing stroke on the draw string 18 (e.g., after one or more charging strokes) causes the transmission to decouple the tensioning cams 215 from the respective tensioning ratchets 220*a*, 220*b*, which prevent decompression of the limbs. The firing stroke may further compress the limbs 105 through the draw 201 as described above, but unlike a charging stroke, causes the transmission to couple the draw string 18 at full draw to the limbs 105 (e.g., by decoupling the tensioning cams 215 from the tensioning ratchets 220). With the tensioning ratchets 220 disengaged, the tensioning cams 215 are free to rotate and output energy stored in the compressed limbs 105. Accordingly, the tensioning cams 215 are operatively coupled to the main cams 210 which, in turn, transfer the stored energy into the draw string 18.

Example Embodiments of a Cam System

Figure 3:
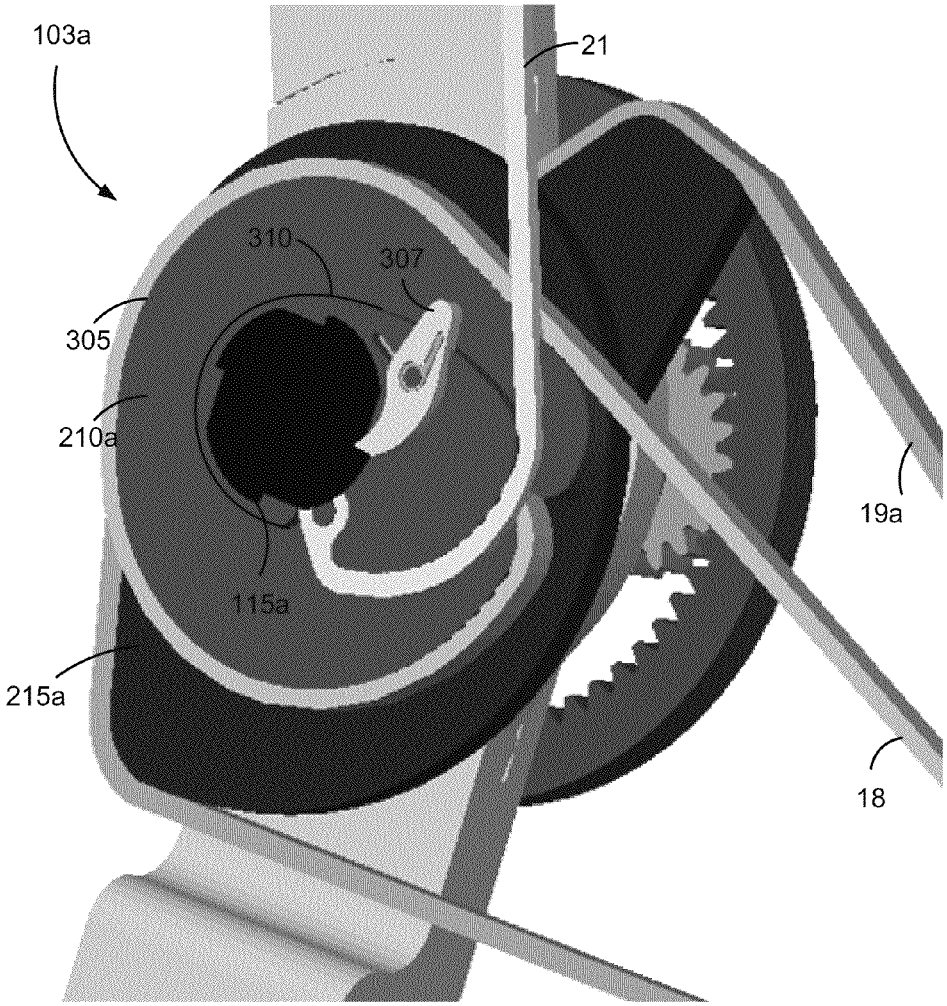
FIG. 3 is a schematic diagram illustrating left-side transmission components according to one embodiment.

FIG. 3 is a schematic diagram illustrating left-side transmission components 103 according to one embodiment. One skilled in the art will readily recognize that, while only lower 103*a* left-side transmission components are shown, the following description of embodiments of the structures and methods illustrated herein is applicable to upper 103*b* left-side transmission components without departing from the principles described herein.

In one embodiment, the left-side transmission components 103 are cam systems including one or more cams 210, 215 coupled to the riser 101, drive shaft 115, tensioning string 19 and/or draw string 18. As shown, the cam system 103*a* includes a main cam 210*a* and a tensioning cam 215*a*. The draw string 18 is coupled to the main cam 210*a* (e.g., via an anchor or pin). A main cam pawl 307 is mounted on the main cam 210*a* and engages the drive shaft 115*a* (e.g., via teeth) when the draw string 18 is drawn to rotate the main cam. In alternate embodiments, the drive shaft 115*a* may include a drive shaft pawl (not shown) for engaging the main cam 210*a* when the draw string 18 is drawn. In other embodiments, a different ratcheting mechanism or a friction based system (e.g., a clutch) is used.

The main cam pawl 307 is mounted on the main cam 210*a* such that the drive shaft 115*a* and main cam 210*a* rotate clockwise together when the bow is drawn. During the draw, the draw string 18 unwinds from the main cam track 305 causing the main cam 210*a* to rotate and engage the drive shaft 115*a*. Conversely, main cam 210*a* rotation during the draw reels in the elastic bias 21 along the elastic bias track 310.

In turn, when the draw string is released after the draw (e.g., to fire the bow or return the draw string 18 to a rest position), the main cam pawl 307 does not engage the drive shaft 115*a* and allows the main cam 210*a* to rotate counter-clockwise due to the elastic bias 21 or compressed limbs 105.

Upper left-side transmission components 103*b* may rotate in an opposite direction of their lower 103*a* counterparts during bow operation.

The main cam 210*a* and track 305 radius (e.g., the distance to the center of the cam/drive shaft) may be shaped according to a desired cam profile to control various forces. In one embodiment, the cam profile of the main cam 210*a* controls the draw force and draw length of the bow experienced by the users. For example, a larger profile cam (e.g., track radius through the draw) tackles more draw string 18, and hence provides a longer draw. Additionally, the larger the radius at any given point, the more leverage, and hence a lower draw force.

Additionally, the cam profile of the main cams 210 may be tuned to provide a desired draw length and draw weight. Some embodiments of the cam profiles of the main cams 210 are further tuned to decrease draw weight when the bow is fully drawn, otherwise known as "let-off", which allows the user to safely manage the force of the compressed limbs 105 prior to releasing the draw string (e.g., to fire the bow).

Figure 4:
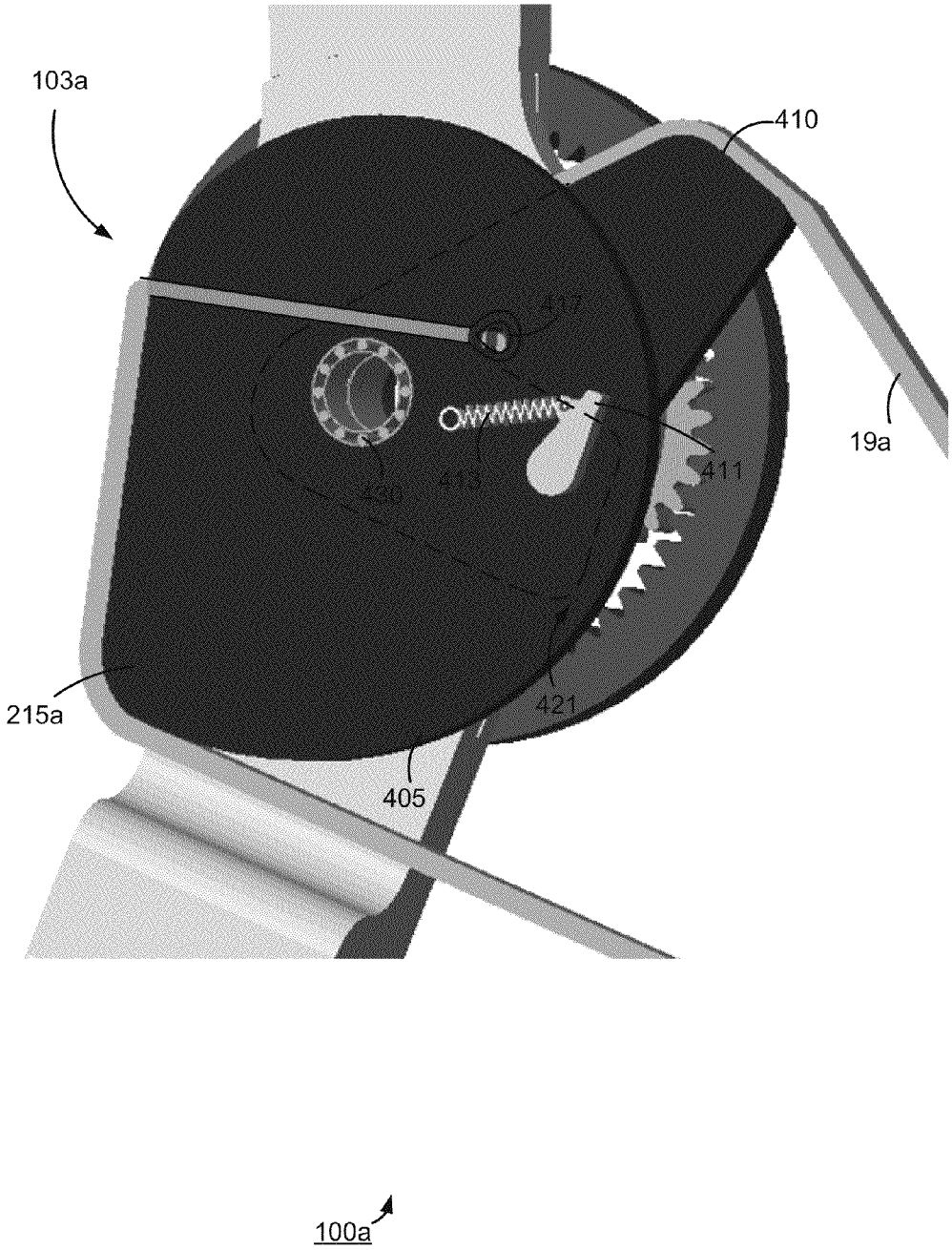
FIG. 4 is a schematic diagram illustrating a tensioning cam according to one embodiment.

FIG. 4 is a schematic diagram illustrating a tensioning cam according to one embodiment. One skilled in the art will readily recognize that, while only lower 103*a* left-side transmission components are shown, the following description of embodiments of the structures and methods illustrated herein is applicable to upper 103*b* left-side transmission components without departing from the principles described herein.

As mentioned above, some embodiments of the lower 103*a* left-side transmission component include a tensioning cam 215*a*. The tensioning cam 215*a* is coupled to the tensioning string 19, and to the riser 101 via the drive shaft 115*a* (not shown). The tensioning cam 215*a* includes a front 405 and rear 410 track for reeling in and reeling out the tensioning string 19*a* as the tensioning cam 215*a* rotates over successive draws and firing of the bow. For example, the tensioning cam 215*a* rotates clockwise to reel in the tensioning string 19*a* and compress the bow limbs 105 and rotates counter-clockwise to reel out the tensioning string when the bow is fired.

The tensioning cam 215*a* may let out and reel in line from the tensioning string 19*a* simultaneously, regardless of the direction it rotates, by means of the front 405 and rear 410 tracks. For example, the front track 405 may reel in line while the rear track 410 lets out line and vice versa. In combination, the front track 405 and rear track 410 collectively enable the tensioning cam 215*a* to reel in the tensioning string 19*a* by taking in more line than it lets out and reel out the tensioning string 19*a* by letting out more line that it takes in. When the tensioning cam 215*a* rotates, the sum of overall reeling in versus reeling out over the course of the rotation causes a corresponding deflection (e.g., compression or decompress) of the limbs when they are tensioned by the tensioning string 19.

Upper left-side transmission components 103*b* may rotate in an opposite direction of their lower 103*a* counterparts during bow operation.

In one embodiment, ends of the tensioning string 19*a* terminate at an anchor 417 on the tensioning cam 215*a*. In other embodiments, the tensioning string 19*a* may loop around a continuous track (e.g., the front 405 and rear 410 tracks are connected).

In some embodiments, the tensioning cam 215*a* includes an output coupling 411 to operatively couple and decouple the tensioning cam 215*a* with the main cam 210*a*. Additionally, the main cam 210*a* may include an input coupling (e.g., an input pin, not shown) for engaging the tensioning cam 215. During firing for example, the output coupling 411 engages the main cam 210*a* and the tensioning cam 215*a* rotates counter-clockwise to transfer energy received at the tensioning cam 215*a* from the limbs 105 into the main cam 210*a*.

Embodiments of the output coupling 411 may be biased with an output spring 413 anchored to the tensioning cam 215*a* to prevent premature coupling with the main cam 210*a* (and/or decoupling from the tensioning ratchet, which is explained in more detail with reference to FIG. 5*a* and FIG. 5*b*). In the illustrated example, the output spring 413 biases the output coupling 411 towards the center of the tensioning cam 215*a*.

The tensioning cam 215*a* and track 405, 410 radii (e.g., to the center of the cam/drive shaft) may be shaped according to a desired cam profile to control various forces. In one embodiment, the cam profile of the tensioning cam 215*a* controls the draw force required to compress the limbs and effective draw length of the bow. For example, a larger profile cam (e.g., track radius through the draw) tackles more tensioning string 19*a*, and hence provides a greater amount of limb deformation (e.g., to compresses the limbs). Additionally, the larger the radius at any given point the more leverage, hence higher draw forces.

In practice, the profile of the tensioning cam 215*a* accounts for three phases of operation as the tensioning cam rotates: rest, charging and firing. The rest phase describes the cam profile prior to compression of the limbs 105 during a draw. In the rest phase, the profile may ensure that torque on the tensioning cam 215*a* from the tensioning string 19*a* is substantially zero and the limbs 105 are preloaded (e.g., compressed into a rest position prior to an initial draw). In one embodiment, the front 405 and back 410 track radii at the points of tension string 19*a* contact during the rest phase are substantially equal or otherwise configured such that net torque on the tensioning can 215*a* is substantially zero when the limbs 105 are preloaded in the rest position.

In the charging phase, the profile may ensure that torque on the tensioning cam 215*a* from the tensioning string 19*a* is increased. The greater the torque, the greater amount of energy that can be stored in a given limb 105. Generally, as shown in FIG. 4, increasing the torque may be achieved with an increased radius of the front 405 track relative to the radius of the back 410 track at the points of tension string 19*a* contact through a compression (and successive compressions) of the limbs 105. In some embodiments, the profile may vary through the charging phase to provide a desired draw force curve. Additionally, in some embodiments, the front 405 and back 410 tracks may be reversed or mirrored to accommodate different bow configurations such as change in tension string 19 position for right/left handed user operation.

In the firing phase (e.g., after one or more charging strokes and fully drawing the bow to fire, known as the firing position), the profile may insure that torque on the tensioning cam 215*a* from the tension string 19*a* is minimized, but is non-zero to bias the bow for firing. Minimizing the torque provides let-off in the firing position, which allows the user to easily aim the bow prior to firing. Without let-off, the user would have to hold back the full force of the limbs 105 with the shooting string (e.g., draw string 18) when the tensioning cam 215 and main cam 210 are coupled. For example, a bow having two charging strokes and a firing stroke, each at 50 pounds per draw, would result in the user having to hold back 150 pounds when the cams are coupled on the firing stroke. A cam profile providing 80 percent let off would reduce the weight the user must hold back to a manageable 30 pounds.

In some embodiments, the cam profile begins minimizing torque on the tensioning cam 215*a* from the tensioning string 19*a* prior to coupling of the tensioning cam to the main cam 210*a* to insure manageable draw weight for the user subsequent to the cams coupling, and/or reduction of frictional force on components coupling (not shown) the tensioning ratchet 220*a* (not shown) and tensioning cam 215*a*. The reduction of frictional force may allow decoupling of the tensioning ratchet 220*a* and tensioning cam 215*a* to occur more easily.

In order to decrease torque on the tensioning cam 215*a* from the tensioning string 19*a* to a reasonable amount in the firing position, the difference in radii of the front 405 track and the back 410 track at the points of tension string 19*a* contact in the full draw position may be minimized. In one embodiment, the radius of the back track 410 is substantially increased at its point of contact with tension string 19*a* in the full draw position, but remains less than the front track 405 (e.g., 421) to bias the tensioning cam 215*a* toward firing (e.g., counter clockwise rotation).

Additionally, the cam profile of the tensioning cam 215*a* may be tuned to provide a desired effective draw length and draw weight. In some embodiments, the cam profile of the tensioning cam 215*a* and main cam 210*a* are considered together for desired input/output characteristics.

FIG. 4 also illustrates an example drive shaft 115*a* bearing 430, according to one embodiment. Various other components detailed herein, such as the tensioning cam 215*a* and output coupling 441, main cam and drive shaft, tensioning ratchet and riser (not shown) and the tensioning ratchet and drive shaft, may be separated by bearings or other sleeve mechanisms to alleviate friction between rotating components. Additionally, in some embodiments, spacers or other mechanisms separate and/or otherwise provide operating margins between adjacent components.

Example Embodiments of a Cam Selection System

Figure 5A:
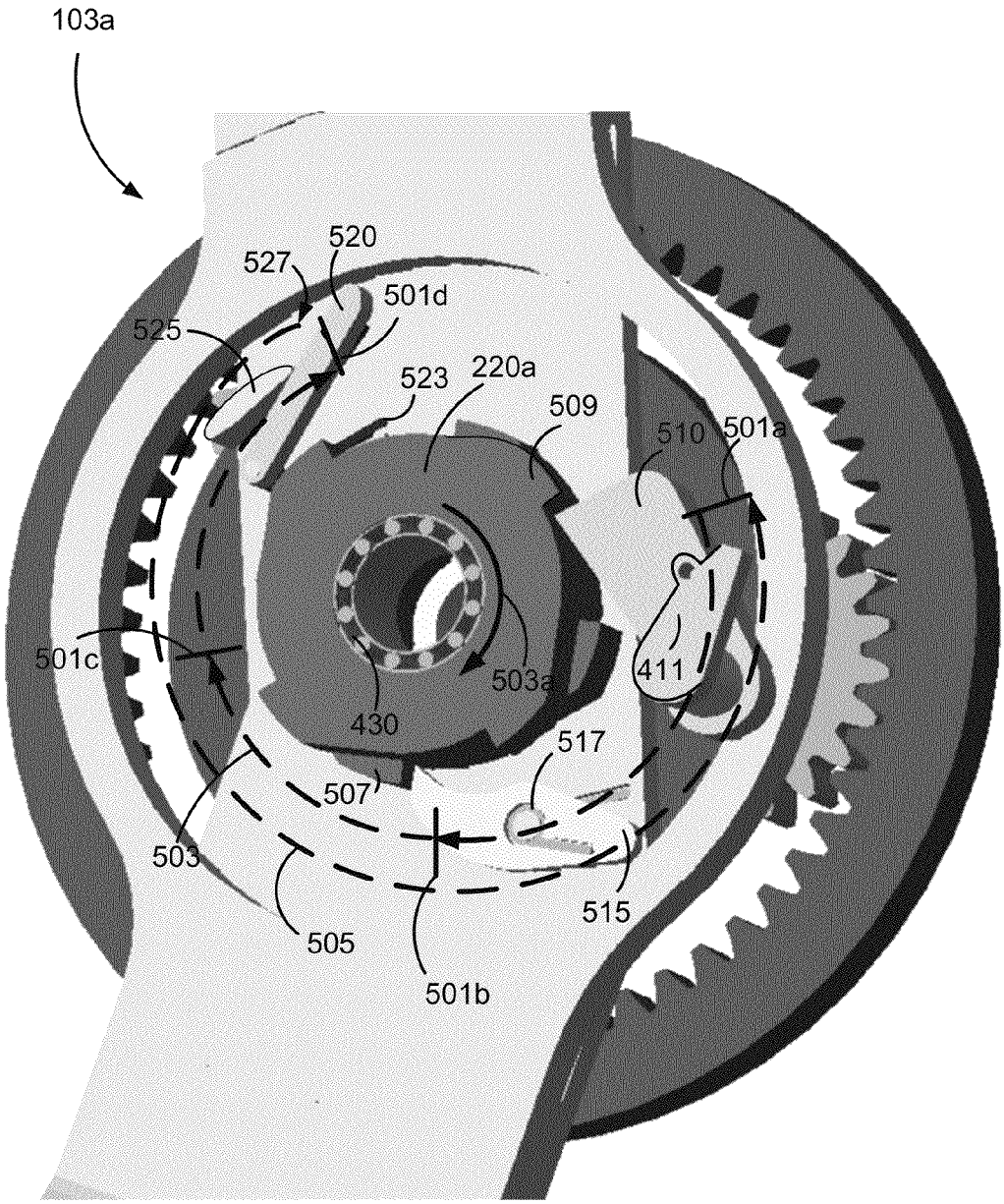
FIG. 5*a* is a schematic diagram illustrating a cam selection system according to one embodiment.

FIG. 5*a* is a schematic diagram illustrating a cam selection system according to one embodiment. In one embodiment, FIG. 5*a* illustrates the lower left-side transmission component 103*a* of FIG. 4 with the tensioning cam 215*a* removed. One skilled in the art will readily recognize that, while only lower 103*a* left-side transmission components are shown, the following description of embodiments of the structures and methods illustrated herein is applicable to upper 103*b* left-side transmission components without departing from the principles described herein.

As shown in FIG. 5*a*, the output coupling 411 of the tensioning cam 215*a* is further coupled to an input coupling 510. The biasing spring 413 (not shown) of the output coupling 411 causes the input coupling 510 to engage the tensioning ratchet 220*a*. In other embodiments, the output coupling 411 and input coupling 510 of the tensioning cam 215*a* may be implemented as separate components.

In some embodiments, the tensioning ratchet 220*a* extends through the riser 101 and is coupled to the riser 101 via one or more bearings (not shown) disposed between the riser 101 and shaft of the ratchet. A drive shaft 115*a* (not shown) may extend through the center of the tensioning ratchet 220*a* and rotate asynchronously from the tensioning ratchet 220*a* via one or more bearings 430.

In some embodiments, the tensioning ratchet 220*a* includes upper 509 and lower 507 teeth. The upper 509 teeth engage the input coupling 510 of the tensioning cam 215*a* and drive the tensioning cam clockwise 503 to compress the limbs 105. The lower 507 teeth engage a tensioning ratchet pawl 515 of the riser 101 to prevent counter-clockwise rotation 505 of the tensioning ratchet 220*a*. The tensioning ratchet pawl 515 may be biased by a spring 517 to engage the lower teeth 507 and prevent any counter-clockwise rotation.

FIG. 5*a* also illustrates a selection gate 520 for decoupling the transmission cam 215*a* from the tensioning ratchet 220*a*. In one embodiment, the selection gate 520 is coupled to the riser 101 and biased by a spring 523, or other mechanism, to force the input coupling 510 to rotate back, and away from the upper teeth 509 of the tensioning ratchet 220*a*. Additionally, the selection gate may cause the output coupling 411 to rotate back, and away from the tensioning ratchet 220*a* (e.g., against the spring bias 413) to engage the main cam 210*a*.

In one embodiment, the input coupling 510 may include a selection pin (not shown, see example embodiment in FIG. 5*b*) on its backside that enters the selection channel formed by the selection gate 520 and the selection guide 525. The selection gate 525 engages the selection pin to decouple the input coupling 510 from the upper tooth 509 of the tensioning ratchet 220*a*. As the selection pin rotates past the channel guide 525, the selection gate 520 guides the selection pin away from the upper tooth 509 and into the firing channel 527. Once the selection pin enters the firing channel 527, the tensioning cam 215*a* can freely rotate counter-clockwise 505 and release the energy stored in the limbs 105. Accordingly, engagement of the output coupling 411 with the main cam 210*a* may occur prior to, coincident with, or after decoupling of the tensioning ratchet 220*a* and the input coupling 510 (e.g., at firing position 501*d*) to prevent the tension cam 215*a* from releasing all its energy without doing work on the main cam 210*a* (and thus insure firing of a projectile coupled to the draw string 18).

In embodiments where the output coupling 411 and input coupling 510 are coupled, the selection gate 520 may additionally cause the output coupling 411 to engage the main cam 210*a* and couple the tensioning cam 215*a* to the main cam 210*a*. Alternative embodiments may include multiple selection gates 520 for separate output 411 and input couplings 510 and/or other combinations or mechanisms to decouple the tensioning cam 215*a* from the tensioning ratchet 220*a* and/or couple the tensioning cam 215*a* and the main cam 210*a*.

Example Operation of a Cam Selection System

As the tensioning cam 215*a* is not shown, FIG. 5*a* denotes an initial rest position 501*a* and firing position 501*d* based on the position of the input coupling 510 of the transmission cam 220*a*. FIG. 5*a* further illustrates first 501*b* and second 501*c* charging stroke positions for a three-draw bow. Similar to the initial rest position 501*a*, charging stroke positions (e.g., 501*b*, 501*c*), are intermediate rest positions after completion of charging strokes on the draw string (e.g., the bow does not fire). Unlike the rest position 501*a*, however, the limbs 105 are further compressed over successive charging stroke positions 501*b*, 501*c* and the lower 507 teeth and pawl 515 prevent the tensioning cam 215*a* from rotating counter clockwise 505 and releasing stored energy.

In other embodiments, additional or fewer draw strokes may be performed based on cam 210, 215 profiles and/or reduction gearing 217*a*. Furthermore, the upper 509 and lower 507 teeth, selection mechanisms 520, 523, 525 and/or other components may be repositioned or otherwise configured based on the desired number of draws or other design considerations.

In practice, for example, when a user draws 201 the shooting string 18, the tensioning ratchet 220*a* is driven clockwise 503. On the first charging draw, the tensioning ratchet 220*a* (e.g., via tooth 509) engages the input coupling 510 of the tensioning cam 215*a* and, in turn, drives the tensioning cam clockwise 503 from the initial rest position 501*a* into the first charging stroke position 501*b* to compresses the limbs 105. Over the course of the draw, lower 507 teeth of the tensioning ratchet 220*a* rotate past the pawl 515.

After the user has fully drawn the draw string 18 and begins to let down the draw string 18 to perform a subsequent charging or firing stroke, the input coupling 510 forces the tensioning ratchet 220*a* counter clockwise due to torque on the tensioning cam 215*a* from compression of the limbs 105. In turn, the lower teeth 507 engage the pawl 515 and effectively couple the tensioning ratchet 220*a* and tensioning cam 215*a* to the riser 101 to prevent release of stored energy.

On the second charging draw, the tensioning ratchet 220*a* drives the input coupling 510 of the tensioning cam 215*a* from the first charging stroke position 501*b* into the second charging stroke position 501*c* to further compresses the limbs 105. When the user has fully drawn the shooting string 18 and begins to let down the draw string 18 to perform a subsequent charging or firing stroke, the input coupling 510 forces the tensioning ratchet 220*a* counter clockwise due to torque on the tensioning cam 215*a* from compression of the limbs 105. In turn, the lower teeth 507 engage the pawl 515 and effectively couple the tensioning ratchet 220*a* and tensioning cam 215*a* to the riser 101 to prevent release of stored energy.

On the third draw, or firing draw, the tensioning ratchet 220*a* drives the input coupling 510 of the tensioning cam 215*a* from the second charging stroke position 501*c* to the firing position 501*d* and further compresses the limbs 105. As the user reaches the fully drawn position of the draw string 18, the input coupling 510 is decoupled (e.g., via the selection gate 520) from the tensioning ratchet 220*a* tooth 509. Additionally, the output coupling 411 engages the main cam 210*a* (e.g., during, or responsive to decoupling of the input coupling 510) and outputs a torque on the main cam. In one embodiment, the selection gate 520 forces a selection pin of the output coupling 510 around the selection guide 525 and into the firing channel 527. In one embodiment, the output torque is minimized based on a cam profile to provide enough let-off such that the user can maintain the draw string 18 in the fully drawn position. While the user maintains the full draw, the input coupling 510 remains in the firing position 501*d*.

In order to fire the bow, the user releases the draw string 18. The limbs 105 decompress and forcefully rotate the main cam 210*a* and tensioning cam 215*a* counter-clockwise 505 from the firing position 501*d* to the initial rest position 501*a*. During the rotation 505, the main cam 210*a* reels in the draw string 18 to launch the projectile.

Additional Cam Selection System Considerations

Figure 5B:
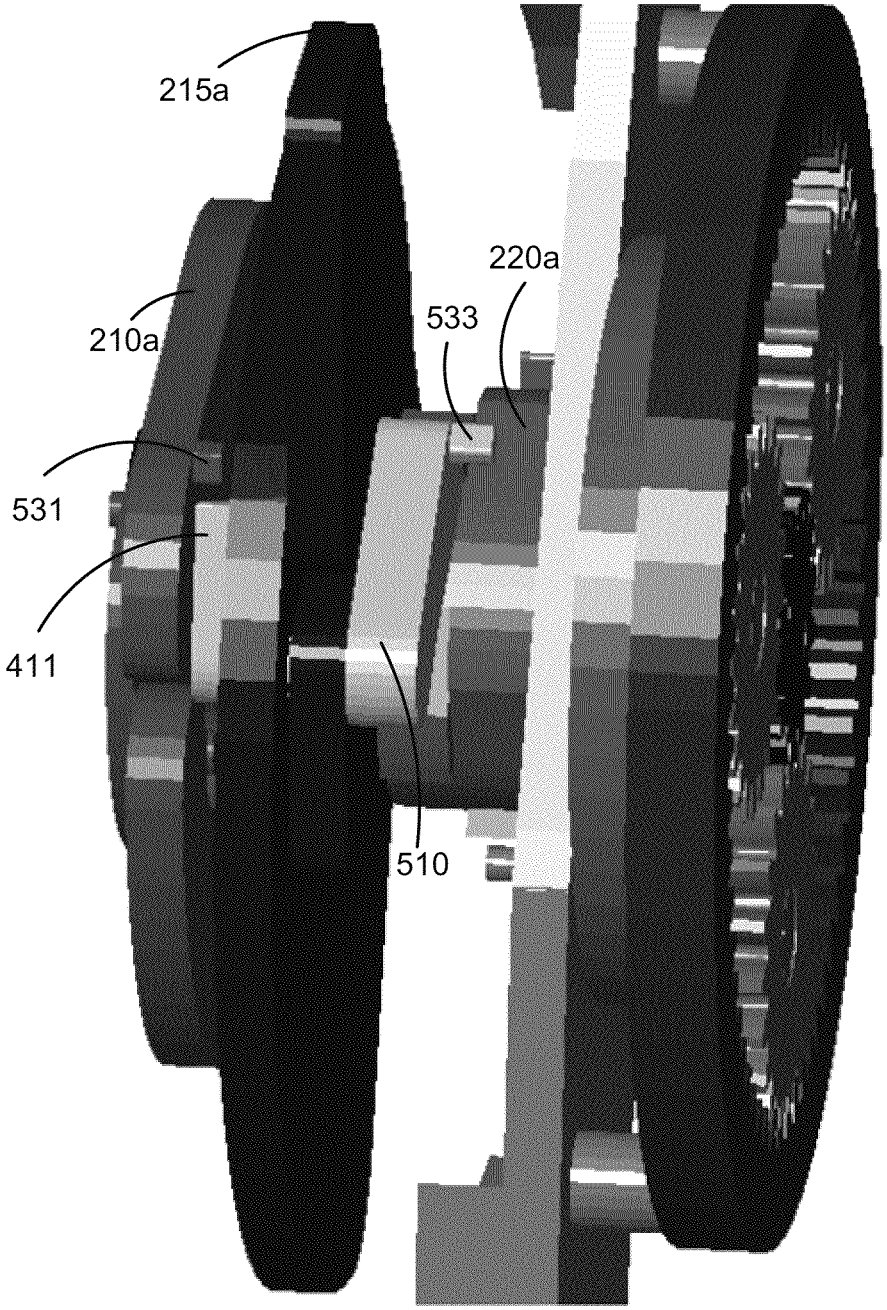
FIG. 5*b* is a schematic diagram illustrating a cam selection system according to one embodiment.

FIG. 5*b* is a schematic diagram illustrating a cam selection system according to one embodiment. In one embodiment, FIG. 5*b* illustrates the lower left-side transmission component 103*a* of FIG. 3. One skilled in the art will readily recognize that, while only lower 103*a* left-side transmission components are shown, the following description of embodiments of the structures and methods illustrated herein is applicable to upper 103*b* left-side transmission components without departing from the principles described herein.

As shown in FIG. 5*b*, the output coupling 411 and the input coupling 510 are respectively disposed on the right and left sides of the transmission cam 220*a*. In one embodiment, the output coupling 411 and input coupling 510 are coupled to the transmission cam 220*a* via shaft and bearing.

FIG. 5*b* also illustrates an example selection pin 533 coupled to the input coupling 510. Additionally, an embodiment of an input pin 531 for coupling the main cam 210*a* and transmission can 215*a* is illustrated. For example, as the input coupling 510 disengages from tensioning ratchet 220*a*, (e.g., when the selection gate 520 engages the selection pin 533), output coupling 411 engages the input pin 531 to couple the cams 210*a*, 220*a*. In some embodiments, the input pin 531 and/or output coupling 411 are grooved or otherwise configured to prevent decoupling during rotation.

The rotation of tensioning cams 215 is controlled by drawing of the shooting string 18 in one direction and the torque resulting from the force of the limbs 105 on the tensioning cables 19 in the other. With the limbs 105 compressed and the bow ready to fire, the transmission 103 should provide a clear path for selection pins 533 to travel as the tensioning cams 215 (and main cams 210) rotate to release energy. Once the cams 210, 215 complete the firing sequence and return to the initial position, they should uncouple. The tensioning cams 215 subsequently reengage the tensioning ratchets 220 for another firing sequence. Ideally, the decoupling/couplings after limb 105 fueled rotations occur subsequent to completion of the firing stroke and any oscillations after release of the projectile to prevent clash or hard stops after energetic rotations.

During the draw of the firing phase, the selection pin 533 travels freely through the transmission 103 until the end of the final draw where the selection pin 533 pushes against the selection gate 520 and compresses the gate bias spring 523. When the selection guide 525 ends, the selection gate 520 forces the selection pin 533 into the firing lane 527. To insure selection, for example, the magnitude of the gate bias spring 523 force on the selection pin 533 should exceed frictional forces between the input coupling 510 and the tensioning ratchet 220. The movement of the selection pin 533 from into the firing track 527 may further cause the output coupling 411 to engage the main cam 210 (e.g., via the input pin 531). In some embodiments, a small gap between the output coupling 411 and the input 531 is implemented to ensure a smooth coupling. As a result of the gap, the limbs 105 force the tensioning cam 215 to rotate a short distance covering the gap to couple the output coupling 411 and input pin 531. At this point the cams 210, 215 are effectively coupled and held together due to the force of the limbs 105 and/or groves or other coupling mechanism. Hence, so long as the torque on the tensioning cams 215, which results from the force of the limbs 105, remains low, (e.g., due to keeping the draw string 18 within the let-off region) the user controls release of the energy stored in the limbs.

In one embodiment, the output coupling 411 and input pin 531 are allowed to disengage each other at the end of the firing stroke. In embodiments where interlocking teeth are used, the tensioning cams 215 may be configured to rotate less than the main cams 210 during firing. Accordingly, the main cams 210 would rotate further at the end of the draw to separate the input pin 531 from the output coupling 411.

In one embodiment, a gap is configured between the main cams 210 and tensioning cams 215 in their rest positions to eliminate clash at the end of the firing stroke between the input coupling 510 and tensioning ratchet 220, the output coupling 411 and the input pin 411, and/or the tensioning ratchet 220 and the tensioning ratchet (e.g., due to clash between the input coupling and tensioning ratchet). The gap between the cams 210, 215 may result in gaps between other components. In some embodiments, buffers are used to minimize clash.

Other embodiments feature different ways of implementing coupling mechanisms between various components. For example, coupling mechanisms using teeth and pawls (e.g., ratchets) may swap placement of the mechanisms on the respective parts. Additionally, biasing springs may be configured to bias couplings in other directions. Furthermore, ratcheting and door mechanisms may be implemented such that engagements and disengagements or couplings occur semi-automatically. For example, decoupling and/or coupling mechanisms (e.g., a manual level coupled to a pawl or output/input coupling 411, 510) may be implemented to prevent or enable a firing sequence.

For embodiments of the various coupling mechanisms detailed herein, alternative implementations further include multiple ratchet pawls moving in unison and multiple notches for synchronous engagement/disengagement to increase strength and/or reliability. In one embodiment, the pawls move in unison by means of a mechanical linkage, for example the pawls could have gear teeth on them. Each pawl may engage a larger gear such that if one pawl rotated every pawl rotated. In a similar manner, the pawls may be linked through sprockets and chains, rubber bands, or any manner of other methods.

In some embodiments, a manually activated lock may be added to one or more ratchet mechanisms. For example, to directly couple the cams and enable the bow to function as a standard compound bow, requiring only one draw. For such an option, it may be desirable to decrease the amount of draw force required (e.g., if gear reduction is used). There are many ways of altering the draw force; two common methods include adjusting a preload setting or draw length. Another example of altering the draw force includes adding pulleys to the cam system to increase or decrease the effective draw length and, in turn, increase or decrease deflection of the limbs. However, example mechanisms used to alter the total deflection of the limbs over the draw strokes and firing stroke is not limited to a pulley system. Any device which takes advantage of the work equals force times distance principle can be used to alter the total deflection of the limbs and thereby alter the total energy storage.

Example Embodiments of a Gear Reduction Mechanism

Figure 6:
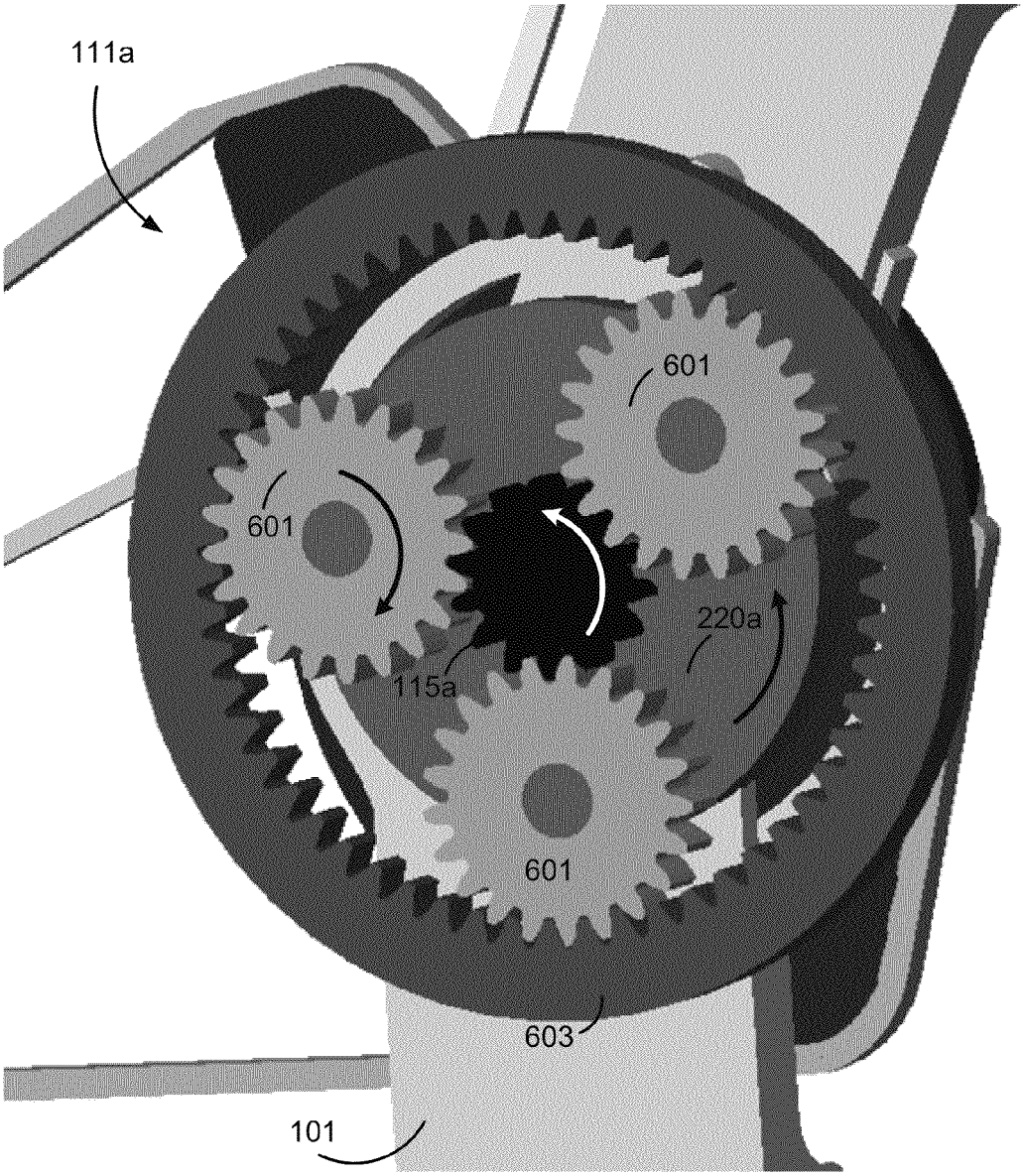
FIG. 6 is a schematic diagram illustrating a reduction mechanism gearing from a right-side view according to one embodiment.

FIG. 6 is a schematic diagram illustrating a reduction mechanism gearing 217 from a left-side view 100*b* of a bow according to one embodiment. As shown, the lower 111*a* right-side transmission component includes a reduction mechanism having a planetary ring gear 603 coupled to the riser 101, a drive shaft 115*a* output sun gear and several planetary gears 601 loaded on a tensioning ratchet 220*a* configured as a planetary gear carrier. In some embodiments, configuration of the lower 111*a* transmission components is substantially mirrored across the axis of the draw 210 for configuring arrangement of the upper 111*b* transmission components.

As the drive shaft 115*a* rotates, it drives the planetary gears 601 in the opposite direction. In turn, the planetary gears 601 rotate around the fixed planetary ring gear 603 and drive the tensioning 220*a* ratchet in the same direction as the drive shaft 115*a*. However, unlike a direct coupling (e.g., via a ratcheting mechanism), the combination of planetary gears 601 and sun gear 115*a* allow tuning of the mechanical advantage the drive shaft 115*a* has over the tensioning ratchet 220*a*, or vice versa, based on the ratio of teeth. The main cam 210 may also be considered in the determination of overall mechanical advantage. For example, the main cam 210 profile may compliment the gearing to provide a desired draw weight for the user.

In practice, as the modification of mechanical advantage provided by the gearing 217*a* alone causes a corresponding change in the ratio of input turns to output turns, the gearing 217*a* output may be fixed for a given tensioning ratchet 220*a* to insure proper rotation for draw and firing phases. As a result, the ratio of drive shaft 115*a* teeth, planetary 601 teeth, and main cam profile may be collectively modified to fine tune any given user's desired draw length and draw weight. Other embodiments may use other gearing mechanisms to rotate the tensioning ratchet 220*a* in response to drive shaft 115*a* input.

The above description is included to illustrate the operation of certain embodiments and is not meant to limit the scope of the invention. The scope of the invention is to be limited only by the following claims. From the above discussion, many variations will be apparent to one skilled in the relevant art that would yet be encompassed by the spirit and scope of the invention.

What is claimed is:

1. An archery apparatus, comprising:
a riser;
a flexible limb;
a draw string;
a tension string; and
a transmission comprising:
a first cam component coupled to the draw string for receiving a first and second input torque,
a second cam component coupled to the tension string for compressing the flexible limb, and
a reduction component operatively coupling the first cam component to the second cam component when receiving the first and second input torque, and configured to convert the input torque received at the first cam component to a first and second output torque received at the second cam component.

2. The archery apparatus of claim 1, further comprising:
a second flexible limb; and
a second transmission comprising:
a first cam component coupled to the draw string for receiving a first and second input torque,
a second cam component coupled to the tension string for compressing the second flexible limb, and
a reduction component operatively coupling the first cam component to the second cam component when receiving the first and second input torque, and configured to convert the first and the second input torque received at the first cam component to a first and second output torque received at the second cam component.

3. The archery apparatus of claim 1, the transmission further comprising a selection component for operatively coupling an input of the reduction component to the first cam component and operatively coupling an output of the reduction component to the second cam component.

4. The archery apparatus of claim 3, wherein the input of the reduction component is configured for receiving torque from the first cam component and the output of the reduction component is configured for outputting a converted torque to the second cam component, the output torque greater than the input torque.

5. The archery apparatus of claim 3, the reduction component further comprising reduction gearing coupling the input of the reduction component to the output of the reduction component for converting torque.

6. The archery apparatus of claim 1, the transmission further comprising a first selection component for operatively decoupling the first cam component from the reduction component.

7. The archery apparatus of claim 6, the transmission further comprising a second selection component for operatively decoupling the second cam component from the reduction component.

8. The archery apparatus of claim 7, the transmission further comprising a third selection component for operatively coupling the first cam component to the second cam component when the first cam component and second cam component are decoupled from the reduction component.

9. The archery apparatus of claim 1, the transmission further comprising a selection component for operatively coupling the first cam component to the second cam component when releasing energy stored in the flexible limb.

10. The archery apparatus of claim 1, wherein the transmission is coupled to the riser.

11. The archery apparatus of claim 10, wherein the draw string and the tension string are coupled to the flexible limb.

12. The archery apparatus of claim 1, wherein the transmission is coupled to the flexible limb.

13. The archery apparatus of claim 12, wherein the draw string and the tension string are coupled to the flexible limb via the transmission.

14. A method of storing energy in a flexible limb, comprising:
compressing the flexible limb to store an amount of energy in response to each of a first and second input torque received at a first cam, including the steps of:
coupling the first cam to a reduction component, the reduction component converting input torque received at the first cam to an output torque;
coupling a second cam to the reduction component to receive the output torque, wherein the second cam causes compression of the flexible limb in response to each of the first and second input torques; and
releasing substantially the sum of energy stored in the flexible limb into a string of a bow by decoupling at least one of the first cam and the second cam from the reduction component.

15. The method claim 14, wherein the first cam and the second cam are decoupled from the reduction component.

16. The method claim 15, wherein releasing substantially the sum of energy stored in the flexible limb further comprises coupling the first cam and the second cam.

17. The method claim 16, wherein the first cam is coupled to the string of the bow for outputting substantially the sum of energy into a projectile.

18. The method claim 16, wherein the second cam is coupled to the string of the bow for outputting substantially the sum of energy into the first cam.

19. The method claim 16, wherein the second cam is coupled to the string of the bow for receiving substantially the sum of energy, the method further comprising coupling the first cam to a second string of the bow for outputting substantially the sum of energy into a projectile.

20. The method claim 14, further comprising decoupling at least one of the first cam and the second cam from the reduction component subsequent to receiving the second input torque.

21. The method claim 14, wherein the compressing of the flexible limb further comprises decoupling the first cam from reduction component subsequent to receiving the first input torque and subsequently coupling the first cam to the reduction component for receiving the second input torque.

22. A method of operating a bow comprising:

receiving two or more input torques at a first transmission component in response to two or more charging strokes for storing energy in one or more flexible limbs;

a step for coupling the first transmission component with a second transmission component during each one of the two or more charging strokes to store energy in the one or more flexible limbs; and a step for decoupling the first transmission component from the second transmission component in response to a last charging stroke in the two or more charging strokes to release substantially the sum of energy stored in the one or more flexible limbs during the charging strokes into a string of the bow.

23. The method of claim 22, further comprising:

a step for converting input torque received at the first transmission component to an output torque, the output torque greater than the input torque; and wherein the step for coupling the first transmission component with the second transmission component during each one of the two or more charging strokes comprises compressing the one or more flexible limbs responsive to the output torque.

24. The method of claim 22, wherein the step for decoupling the first transmission component from the second transmission component in response to a last charging stroke in the two or more charging strokes to release substantially the sum of energy stored in the flexible limbs into a string of the bow further comprises a step for configuring at least one cam to receive substantially the sum of energy and output substantially the sum of energy into the string of the bow.

* * * * *